US006445268B1

(12) United States Patent
Daum

(10) Patent No.: US 6,445,268 B1
(45) Date of Patent: Sep. 3, 2002

(54) INSTANTANEOUS TRIP POWER TRANSFORMER

(75) Inventor: Wolfgang Daum, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/670,331

(22) Filed: Sep. 27, 2000

Related U.S. Application Data

(63) Continuation-in-part of application No. 09/143,063, filed on Aug. 28, 1998, now abandoned.

(51) Int. Cl.[7] ..... H01H 9/00

(52) U.S. Cl. ..... 335/172; 335/18; 336/170; 336/182

(58) Field of Search ..... 335/167–172; 336/180–182, 170; 361/42–51; 338/18, 251, 257, 246

(56) References Cited

U.S. PATENT DOCUMENTS

| | | | | |
|---|---|---|---|---|
| 1,872,369 A | | 8/1932 | Van Sickle | 335/256 |
| 2,407,603 A | | 9/1946 | Derungs | 335/177 |
| 3,975,721 A | | 8/1976 | Franz | 335/117 |
| 5,206,616 A | | 4/1993 | Stegmuller | |
| 5,327,112 A | * | 7/1994 | Rossetti | 335/78 |

* cited by examiner

*Primary Examiner*—Lincoln Donovan
*Assistant Examiner*—Tuyen T. Nguyen
(74) *Attorney, Agent, or Firm*—George C. Goodman; Donald S. Ingraham

(57) ABSTRACT

An instantaneous trip power transformer includes a high current main outer winding wound to have one or more turns, for providing the main breaker contact current path and for serving as the transformer primary winding for providing power to the breaker electronic components. The transformer includes a secondary winding configured to provide power to trip circuit electronic components. The secondary winding is wound in a substantially cylindrical shape and has a bore therethrough. The main outer winding is wound around an outer surface of the secondary winding. The secondary winding supplies power to the trip circuitry. A third, or trip, winding is located within the secondary winding bore, and is configured to trip the breaker under electronic control by the trip circuitry. The third winding is wound in a substantially cylindrical shape and is energized by the trip circuitry. A tripping mechanism activation plunger, adapted to be driven by the main outer winding and/or the trip winding, extends from one end of the third winding and is adapted to be coupled to the breaker switch.

19 Claims, 2 Drawing Sheets

INSTANTANEOUS TRIP POWER TRANSFORMER

This application is a continuation-in-part of application Ser. No. 09/143,063, filed Aug. 28, 1998 now abandoned.

FIELD OF THE INVENTION

This invention relates generally to circuit breakers and, more particularly, to a power transformer with a small form factor.

BACKGROUND OF THE INVENTION

Arc detection often is performed to protect house wiring and consumer wiring, e.g., extension cords, appliance cords and appliances. Generally, upon detection of an arc, it is desirable to open the circuit in which the arc is detected. Although arc detection is desirable, some known residential circuit breakers are large and expensive, which often precludes their use.

For example, some known residential circuit breakers that include integral arc detection units typically include a separate power supply, sometimes referred to in the art as a "pig tail", to supply power to the arc detection electronics and a separate over-current trip unit. Such power supplies and trip units may be physically large. In order to include the power supply and trip unit within the circuit breaker enclosure, the circuit breaker housing typically must be increased in size from, for example, a 0.5" form factor housing to a 1.0" form factor housing.

The size of the breaker housing sometimes prevents such breaker from being used in at least some residential applications due to space constraints. Moreover, increased housing size also results in increased breaker cost.

It would be desirable to provide a power supply and trip unit for use in residential circuit breakers that perform the necessary functions and yet are relatively small in physical size. It also would be desirable to provide such power supply and trip unit in a form that is simple to fabricate and low in cost.

SUMMARY OF THE INVENTION

An instantaneous trip power transformer particularly well suited for residential circuit breaker applications includes a transformer, in an exemplary embodiment, having a high current main outer winding conductor. The main outer winding conductor may be wound to have one or more turns and provides the main breaker contact current path. The main outer winding conductor also serves as the primary winding for the power transformer to provide power to the breaker electronic components.

The transformer also includes a secondary winding configured to provide power to trip circuit electronic components. The secondary winding is wound to have a substantially cylindrical shape with a bore therethrough. The main outer winding conductor is wound around an outer surface of the secondary winding conductor. Leads are electrically coupled to, and extend from, the secondary winding conductor for supplying power to the trip circuit.

A third, or trip, winding is located within the secondary winding bore and is configured to trip the breaker under electronic control. Specifically, the third winding is wound to have a substantially cylindrical shape. Leads are electrically coupled to, and extend from, the third winding conductor to the trip circuit. A conducting cylinder is located in the third winding bore, and a tripping mechanism activation plunger is at least partially located in the cylinder and extends from one end of the third winding conductor. The plunger is mechanically coupled to a spring loaded switch that, in turn, spans the breaker main contact, as is well known in the art.

Prior to operation, the primary winding conductor is electrically coupled between a power supply, e.g., an AC power line, and the electronic components of the circuit breaker. The secondary conductor leads are electrically coupled to the trip circuit for supplying power thereto, and the third winding leads are electrically coupled to the electronic trip circuit.

In operation, current flows through the primary winding conductor and the primary winding conductor serves as the main breaker current path. Current induced in the secondary winding conductor from the primary winding conductor is utilized to power the trip circuit components. Under normal tripping conditions, the trip circuit activates the third coil with energy stored, for example, in a capacitor. The DC field from the third winding conductor is superimposed on the AC field generated by the primary winding conductor. As a result, the plunger activates the mechanical spring loaded switch.

In the event of a high current, e.g., a short circuit or its equivalent, in primary winding conductor 14, the increase in magnetic force of the primary winding conductor field activates tripping plunger 32 so that the plunger moves from the switch closed, i.e., plunger 32 inactivated position 37, to the switch open, i.e., plunger 32 activated position 38. The current level at which tripping plunger 32 moves from the inactivated to the activated position is selectable, and usually the high current is designated as a current in the range of 110 amps to 170 amps for a 15 amp or 20 amp circuit breaker. When plunger 32 is in the activated position, the breaker is "tripped." Such tripping of the breaker is provided without requiring any control signals from the trip circuit. Rather, when a high current condition exists in primary winding conductor 14, plunger 32 is tripped due to the increase in force of the primary winding conductor AC field.

The above described integral trip coil and power transformer provides the important advantage of performing the required functionality, i.e., power supply and high current instantaneous trip, yet is small in size. Rather than using a 1" form factor housing for a residential circuit breaker, a smaller size housing can be utilized. In addition, the transformer is not difficult to fabricate and is not expensive.

DETAILED DESCRIPTION

Figure 1:
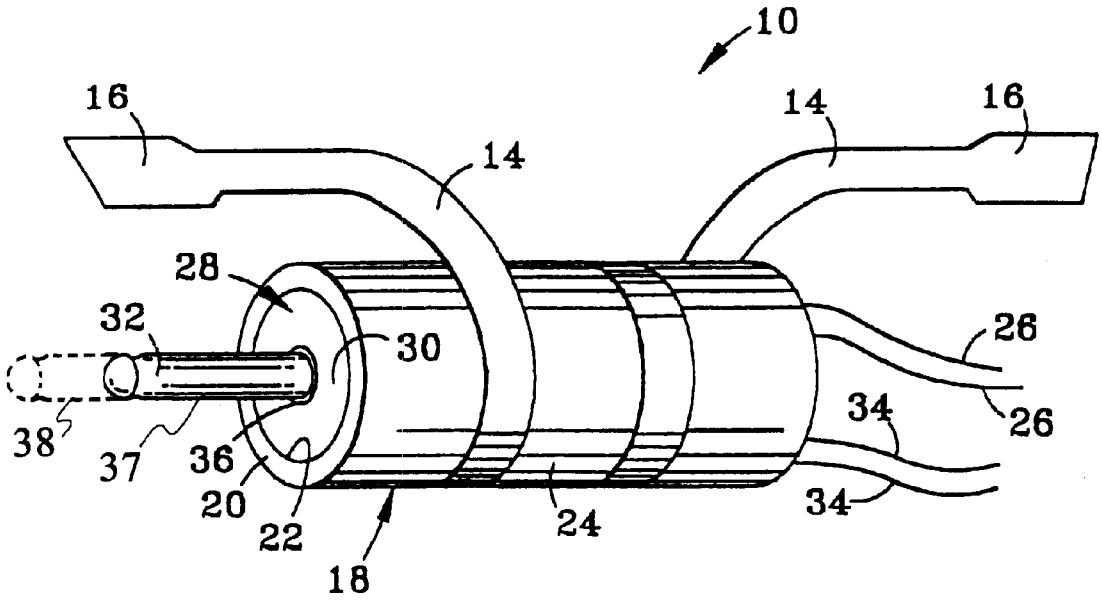
FIG. 1 is a schematic illustration of an integral power transformer and trip unit in accordance with one embodiment of the present invention.

The single Figure illustrates an integral, instantaneous trip, power transformer 10 in accordance with one embodiment of the present invention. Although transformer 10 is sometimes described herein in the context of residential applications, it will be understood that transformer 10 may be utilized in other than residential applications. In addition, transformer 10 can be incorporated into known circuit breakers or implemented separately from such circuit breakers, so as to constitute a transformer/actuator for the circuit breaker, and the unit is not limited to practice with any one particular type of circuit breaker.

Transformer 10 includes a high current main outer winding formed by a conductor 14. Main outer winding conductor 14 may be wound to have one or more turns and provides a main breaker contact current path. Main outer winding conductor 14 also serves as the primary winding for transformer 10 to provide power to at least some electronic components of the breaker, e.g., the trip circuit (not shown). Connection pads 16 are located at opposing ends of conductor 14 to facilitate connecting transformer 10 in the primary power path.

Transformer 10 also includes a secondary winding 18 configured to provide power to the trip circuit electronic components (not shown). Secondary winding 18, in the illustrated embodiment, is formed by a conductor 20 wound into a substantially cylindrical shape having a bore 22 therethrough. Main outer winding conductor 14 is wound around an outer surface 24 of secondary winding conductor 20. Leads 26 are electrically connected to, and extend from, secondary winding conductor 20 for supplying power to the trip circuit.

A third, or trip, winding 28 is located within, and concentric with, secondary winding bore 22. Third winding 28 is configured to trip the breaker under electronic control. Specifically, third winding 28 is formed by a conductor 30 wound into a substantially cylindrical shape. Conductor 30 is in electrical contact with leads 34 which are coupled to the trip circuit electronics (not shown). A conducting cylinder (not shown) may be located in the bore formed by third winding 28, and a tripping mechanism activation plunger 32 is at least partially located within the cylinder and extends from one end of third winding conductor 30. Tripping plunger 32 is known in the art.

To fabricate transformer 10, a cylindrical coil former (insulated) may be utilized. Coil formers are well known in the art. Second and third insulated conductors 20 and 30 are wound using the coil former (not shown) and leads 26 and 34 are electrically connected to conductors 20 and 30, respectively. Conductors 20 and 30 may, for example, be insulated copper conductors.

More specifically, third conductor 30 is wound on the coil former, and second conductor 20 is then wound on third conductor 30. In an exemplary embodiment, a cylinder 36 fabricated of soft iron having low magnetic losses and dimensions so that the cylinder fits inside the bore defined by third conductor 30 is selected. In an alternative embodiment, the cylinder may be fabricated of laminated steel. In any event, the cylinder is mechanically connected to the housing, and the insulated coil former is slid over the cylinder. The cylinder provides magnetic coupling between conductors 20 and 30 and plunger 32.

Primary winding conductor 14 is then wound on second conductor 20. Plunger 32, fabricated of soft iron or, in an alternative embodiment, from laminated (transformer) steel, is positioned inside the cylinder. Plunger 32 is mechanically coupled to a spring loaded switch that, in turn, spans the breaker main contact, as is well known in the art.

Prior to operation, primary winding conductor 14 is electrically coupled between a power supply, e.g., an AC power line (not shown), and the electronic components of the circuit breaker (not shown). Secondary conductor leads 26 are electrically coupled to the trip circuit for supplying power thereto, and third winding leads 34 are electrically coupled to the electronic trip circuit so that control signals can be transmitted to transformer 10. Plunger 32 is mechanically coupled to the breaker switch mechanism (not shown) to operate the switch.

In operation, current flows through primary winding conductor 14, which serves as the main breaker current path. Current induced in secondary winding conductor 20 from primary winding conductor 14 is utilized to power the trip circuit components. Under normal tripping conditions, the tripping circuit activates trip, or third, winding 28 with energy stored, for example, in a capacitor (not shown). The DC field from third winding conductor 30 is superimposed on the AC field generated by primary winding conductor 14. As a result, plunger 32 activates the breaker switch.

In the event of a high current, e.g., a short circuit or its equivalent, in primary winding conductor 14, the increase in magnetic force of the primary winding conductor field activates tripping plunger 32 so that the plunger moves from the switch closed, i.e., plunger 32 inactivated position, to the switch open, i.e., plunger 32 activated, position. The current level at which tripping plunger 32 moves from the inactivated to the activated position is selectable, and usually the high current is designated as a current in the range of 110 amps to 170 amps for a 15 amp or 20 amp circuit breaker. When plunger 32 is in the activated position, the breaker is "tripped". Such tripping of the breaker is provided without requiring any control signals from the trip circuit. Rather, when a high current condition exists in primary winding conductor 14, plunger 32 is tripped due to the increase in force of the primary winding conductor AC field.

In addition to the instantaneous tripping described above, a control signal can be transmitted from the trip circuit to third winding conductor 30 via leads 34. The control signal may, for example, be a high voltage level signal which causes plunger 32 to move from the switch making position to the switch breaking position. Therefore, in addition to providing an instantaneous trip upon occurrence of a short circuit or the like, transformer 10 can be caused to trip by an externally applied voltage from the trip circuit.

Integral trip coil and power transformer 10 provides the required functionality, i.e., power supply and high current instantaneous trip, yet is small in size. Rather than using a 1" form factor housing for a residential circuit breaker, a smaller size housing (e.g., a 0.75" form factor housing) can be utilized. In addition, transformer is not difficult or expensive to fabricate.

Figure 2:
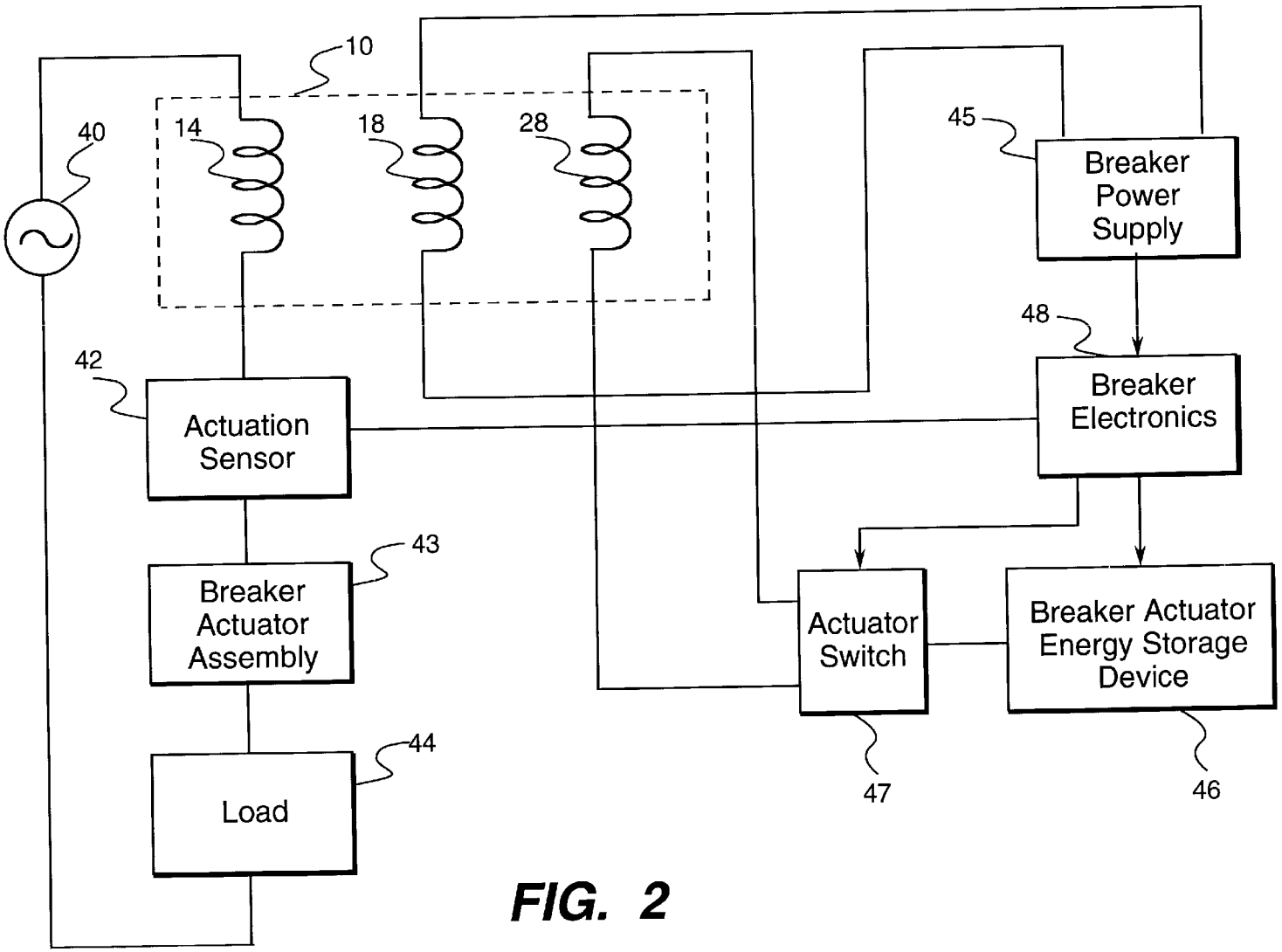
FIG. 2 is a block diagram of the apparatus of FIG. 1 connected as a circuit breaker.

FIG. 2 shows the breaker electronic/electrical components and interactions. The breaker transformer/actuator 10 is connected to the main AC power source 40 to the building (e.g., home) in which it is located and situated in the load center feeding the branch circuit that it is supposed to protect. The breaker protects under both short circuit and other faults conditions.

The electrical connection from power source 40 to transformer/actuator 10 is via primary winding 14, which serves a dual function: under short circuit conditions, where a load 44 presents a short circuit to the power source, the primary winding actuates the breaker assembly and trips the breaker, thus limiting overcurrent conditions. For a 15 or 20 amp breaker this situation can occur via a direct line to neutral short or line to line short or where load currents exceed about 50–200 amps and a fast (i.e., less than 1 millisecond—1 second) interrupt is required. For fast interrupt, breaker actuation by the electronics and sensor system does not need to be relied upon since primary winding 14 provides sufficient magnetic force to the actuator assembly to trip the breaker. Higher values would apply for higher rating breakers.

The second function of primary winding 14 is to act as the primary of a power supply transformer that provides power to both the sensor electronics, which may include the fault sensor, or sensors, such as ground fault, overcurrent fault and arc fault sensors, or combinations thereof, and a breaker actuator energy storage device 46, such as a capacitor, battery or other electrical storage device, as well as breaker electronics 48.

Primary winding 14 is connected to an actuation sensor 42 which in turn is coupled to load 44 through breaker actuator assembly 43, thus completing the electrical connection to the main power source. The load may comprise many different forms of reactive and non-reactive loads such as motors, heaters, lamps, appliances, wiring etc. Alternatively, the load may comprise a dummy load to maintain a minimal current flow through the breaker to ensure that the breaker electronics is powered and that the breaker actuator energy storage device, connected to third winding 28, is being charged.

Secondary winding 18 of the multi purpose transformer/actuator energizes a power supply 45 in order to feed local breaker electronics 48 (and any sensor where applicable) plus breaker actuator energy storage device 46, which includes, as peripheral circuitry, a rectifier, filter and regulator assembly as well known in the art, and an actuator switch 47.

Breaker electronics 48 obtains fault sensor input signals from actuation sensor 42, and looks for load faults. The breaker electronics employs analog and digital sensor signal processors plus associated circuitry, as known in the art, to monitor the sensor signals and determine fault conditions.

Breaker electronics 48 in turn signals breaker actuator switch 47 to connect breaker actuator energy storage device 46 to third winding 28 that then trips the breaker. In an exemplary embodiment, the energy required to trip the breaker under a fault condition is higher than what breaker power supply 45 can provide instantaneously, thus requiring breaker actuator energy storage device 46 to provide the required energy to third winding 28 to trip the breaker. Energy storage occurs over a time interval that overlaps and exceeds the instantaneous fault trip time of 1 ms–1 sec. In an alternative embodiment where the breaker power supply can provide sufficient power under fault conditions to trip the breaker, the actuator energy storage device is not needed.

The winding sequence can be changed, as long as the winding purpose is maintained. The winding isolation is an exemplary embodiment and in an alternative embodiment winding isolation is not maintained.

In another alternative embodiment, at least one of the windings can be used as a fault sensor, where a current signature is used for arc fault detection. An overcurrent signature is thus used for overcurrent detection and also presence of current above a threshold for ground fault detection. In this latter embodiment the winding or windings are also connected to the breaker electronics.

While only certain preferred features of the invention have been illustrated and described, many modifications and changes will occur to those skilled in the art. For example, rather than using a cylinder with a circular cross section shape to provide magnetic coupling between the conductors and the plunger of the power transformer trip unit, a cylinder having a rectangular cross sectional shape could be used. It is, therefore, to be understood that the appended claims are intended to cover all such modifications and changes as fall within the true spirit of the invention.

What is claimed is:

1. Apparatus for performing power transformer and instantaneous trip functions, comprising:

a high current main outer winding comprising a conductor;

a second winding comprising a conductor wound in a cylindrical shape and having a bore therethrough, said main outer winding wound at least partially around said second winding conductor;

a third winding located within said second winding conductor bore;

a circuit breaker actuator assembly;

an actuation sensor, said circuit breaker actuator assembly and said actuation sensor being coupled in a series circuit with said high current main outer winding and a load, said series circuit being adapted to be coupled across a main alternating current power supply;

circuit breaker electronic circuitry responsive to said actuation sensor for determining fault conditions; and an actuator switch controlled by said circuit breaker electronic circuitry to supply energy to said third winding and thereby trip a breaker when a fault condition has been determined by said circuit breaker electronic circuitry.

2. Apparatus in accordance with claim 1 including a breaker actuator energy storage device coupled to said actuator switch for providing the energy to said third winding to trip the breaker when a fault condition has been determined by said circuit breaker electronic circuitry.

3. Apparatus in accordance with claim 1 wherein said third winding comprises a conductor wound in a cylindrical shape having a bore therethrough, said apparatus further comprising a cylinder located within said third winding bore.

4. Apparatus in accordance with claim 3 wherein said circuit breaker actuator assembly includes a tripping mechanism activation plunger at least partially located within said cylinder and extending from one end of said third winding conductor, said plunger being movable from an inactivated position to an activated position.

5. Apparatus in accordance with claim 4 wherein said cylinder and said plunger are comprised of at least one of the group consisting of soft iron and laminated steel.

6. Apparatus in accordance with claim 4 wherein said plunger is adapted to move from said inactivated position to said activated position when a high current flows through said main outer winding.

7. Apparatus in accordance with claim 1 wherein each of said high current main outer winding, said second winding conductor, and said third winding, comprises an insulated conductor, respectively.

8. Apparatus for performing a function in conjunction with a circuit breaker, comprising:

a high current main outer winding for providing a main current path and being a primary winding for a power transformer;

a secondary winding for said power transformer comprising a conductor wound in a cylindrical shape and having a bore therethrough, said main outer winding wound at least partially around said secondary winding conductor;

a third instantaneous trip winding located within said secondary winding conductor bore;

a circuit breaker actuator assembly;

an actuation sensor, said circuit breaker actuator assembly and said actuation sensor being coupled in a series circuit with said primary winding and a load, said series circuit being adapted to be coupled across a main alternating current power supply;

a circuit breaker power supply coupled across said secondary winding;

circuit breaker electronic circuitry coupled to said circuit breaker power supply and responsive to said actuation sensor for determining fault conditions; and an actuator switch controlled by said circuit breaker electronic circuitry to supply energy to said third winding and thereby trip the circuit breaker when a fault condition has been determined by said circuit breaker electronic circuitry.

9. Apparatus in accordance with claim 8 including a breaker actuator energy storage device coupled to said actuator switch for providing the energy to said third winding to trip the breaker when a fault condition has been determined by said circuit breaker electronic circuitry.

10. Apparatus in accordance with claim 8 wherein said third winding comprises a conductor wound in a cylindrical shape having a bore therethrough.

11. Apparatus in accordance with claim 10 and further comprising a cylinder located within said third winding bore.

12. Apparatus in accordance with claim 11 wherein said circuit breaker actuator assembly includes a tripping mechanism activation plunger at least partially located within said cylinder and extending from one end of said third winding conductor, said plunger being movable from an inactivated position to an activated position.

13. Apparatus in accordance with claim 12 wherein said plunger is adapted to move from said inactivated position to said activated position when a high current flows through said primary winding.

14. Apparatus for tripping a breaker switch, comprising:

a high current main outer winding comprising a conductor for providing a main current path and being a primary winding for a power transformer;

a secondary winding for said power transformer comprising a conductor wound in a cylindrical shape and having a bore therethrough, said main outer winding conductor wound at least partially around said secondary winding conductor;

a third instantaneous trip winding located within said secondary winding conductor bore;

a tripping mechanism activation plunger extending from one end of said third winding conductor, said plunger being adapted to be coupled to said breaker switch;

a circuit breaker actuator assembly;

an actuation sensor, said actuation sensor being coupled in a series circuit with said primary winding and a load, said series circuit being adapted to be coupled across a main alternating current power supply;

circuit breaker electronic circuitry responsive to said actuation sensor for determining fault conditions; and an actuator switch controlled by said circuit breaker electronic circuitry to supply energy to said third winding and thereby trip the breaker switch when a fault condition has been determined by said circuit breaker electronic circuitry.

15. Apparatus in accordance with claim 14 wherein said main outer winding, said secondary winding conductor, and said third winding conductor are formed from one of the group consisting of low magnetic loss iron and laminated steel.

16. Apparatus in accordance with claim 14 wherein said third winding is wound in a cylindrical shape having a bore therethrough, said apparatus further comprising a cylinder located within said third winding bore.

17. Apparatus in accordance with claim 16 wherein said plunger and said cylinder are formed of one of the group consisting of low magnetic loss soft iron and laminated steel.

18. Apparatus in accordance with claim 15 wherein said plunger is formed of one of the group consisting of low magnetic loss soft iron and laminated steel.

19. Apparatus in accordance with claim 14 including a breaker actuator energy storage device coupled to said actuator switch for providing the energy to said third winding to trip the breaker when a fault condition has been determined by said circuit breaker electronic circuitry.

* * * * *